US011092376B2

(12) United States Patent
Babucke et al.

(10) Patent No.: US 11,092,376 B2
(45) Date of Patent: Aug. 17, 2021

(54) REFRIGERATION DEVICE COMPRISING MULTIPLE STORAGE CHAMBERS

(71) Applicant: BSH HAUSGERAETE GMBH, Munich (DE)

(72) Inventors: Andreas Babucke, Heidenheim (DE); Niels Liengaard, Ulm (DE)

(73) Assignee: BSH Hausgeraete GmbH, Munich (DE)

( * ) Notice: Subject to any disclaimer, the term of this patent is extended or adjusted under 35 U.S.C. 154(b) by 56 days.

(21) Appl. No.: 16/075,814

(22) PCT Filed: Jan. 31, 2017

(86) PCT No.: PCT/EP2017/051971
§ 371 (c)(1),
(2) Date: Aug. 6, 2018

(87) PCT Pub. No.: WO2017/140488
PCT Pub. Date: Aug. 24, 2017

(65) Prior Publication Data

US 2019/0032986 A1 Jan. 31, 2019

(30) Foreign Application Priority Data

Feb. 19, 2016 (DE) ..... 10 2016 202 565.1

(51) Int. Cl.
*F25D 11/02* (2006.01)
*F25D 13/02* (2006.01)
(Continued)

(52) U.S. Cl.
CPC ..... *F25D 11/022* (2013.01); *F25B 5/00* (2013.01); *F25B 5/02* (2013.01); *F25B 40/00* (2013.01);
(Continued)

(58) Field of Classification Search
CPC ..... F25D 13/02; F25D 13/04; F25D 11/00; F25D 11/022; F25B 5/02; F25B 5/04;
(Continued)

(56) References Cited

U.S. PATENT DOCUMENTS 4,439,996 A * 4/1984 Frohbieter ..... F25B 5/04 62/174
4,513,581 A * 4/1985 Mizobuchi ..... F25B 5/04 62/117
(Continued)

FOREIGN PATENT DOCUMENTS

CN 1878994 A 12/2006
CN 102080895 A 6/2011
(Continued)

*Primary Examiner* — Brian M King
*Assistant Examiner* — Erik Mendoza-Wilkenfeld
(74) *Attorney, Agent, or Firm* — Laurence A. Greenberg; Werner H. Stemer; Ralph E. Locher

(57) ABSTRACT

A refrigeration device has a first storage chamber, a second storage chamber and a refrigerant circuit, in which a first controllable throttle point, a first heat exchanger for controlling the temperature of the first storage chamber, a second controllable throttle point and a second heat exchanger for cooling the second storage chamber are connected in series between a pressure connection and a suction connection. A hot line section, located upstream of the second heat exchanger, and a cold line section, located downstream of the second heat exchanger, are routed in thermal contact with respect to one another in order to form an internal heat exchanger. The first heat exchanger is connected to the pressure connection bypassing the hot line section.

10 Claims, 1 Drawing Sheet

(51) Int. Cl.

| | |
|---|---|
| ***F25B 5/02*** | (2006.01) |
| ***F25B 5/04*** | (2006.01) |
| ***F25B 40/00*** | (2006.01) |
| ***F25B 5/00*** | (2006.01) |
| ***F25B 49/02*** | (2006.01) |
| *F25B 41/39* | (2021.01) |
| *F25B 41/385* | (2021.01) |

(52) U.S. Cl.
CPC ..... *F25B 49/02* (2013.01); *F25B 41/385* (2021.01); *F25B 41/39* (2021.01); *F25B 2341/062* (2013.01); *F25B 2400/052* (2013.01); *F25B 2400/054* (2013.01)

(58) Field of Classification Search
CPC .. F25B 2600/2501; F25B 40/04; F25B 40/06; F25B 2400/052; F25B 2400/054
See application file for complete search history.

(56) References Cited

U.S. PATENT DOCUMENTS

| | | | | |
|---|---|---|---|---|
| 4,918,942 | A | 4/1990 | Jaster | |
| 5,103,650 | A * | 4/1992 | Jaster | F25B 1/10 62/198 |
| 5,157,943 | A | 10/1992 | Jaster et al. | |
| 5,228,308 | A * | 7/1993 | Day | F25B 5/04 62/198 |
| 5,243,837 | A * | 9/1993 | Radermacher | F25B 5/04 62/513 |
| 6,286,326 | B1 * | 9/2001 | Kopko | F25D 17/065 62/179 |
| 6,644,044 | B2 * | 11/2003 | Kranz | F25B 5/00 285/93 |
| 6,775,998 | B2 * | 8/2004 | Yuasa | F25B 5/00 62/197 |
| 7,017,353 | B2 | 3/2006 | Gist et al. | |
| 7,587,905 | B2 * | 9/2009 | Kopf | F25D 21/08 62/137 |
| 2007/0137230 | A1 * | 6/2007 | Bae | F25B 5/04 62/198 |
| 2007/0151268 | A1 * | 7/2007 | Jang | F25B 41/06 62/197 |
| 2013/0213064 | A1 * | 8/2013 | Gomes | F25D 29/00 62/115 |
| 2014/0245758 | A1 * | 9/2014 | Gu | F25D 29/00 62/56 |
| 2015/0184898 | A1 * | 7/2015 | Vaisman | F25B 5/00 62/115 |
| 2015/0184926 | A1 * | 7/2015 | Yun | F25B 47/022 62/81 |
| 2016/0320116 | A1 * | 11/2016 | Klingshirn | F25B 41/062 |
| 2017/0057320 | A1 | 3/2017 | Song et al. | |

FOREIGN PATENT DOCUMENTS

| | | | |
|---|---|---|---|
| CN | 104251579 | A | 12/2014 |
| DE | 102013226341 | A1 | 6/2015 |
| JP | 2001108319 | A | 4/2001 |
| WO | 0179772 | A1 | 1/2001 |
| WO | 2015178596 | A1 | 11/2015 |

* cited by examiner

REFRIGERATION DEVICE COMPRISING MULTIPLE STORAGE CHAMBERS

BACKGROUND OF THE INVENTION

Field of the Invention

The present invention relates to a refrigeration device, in particular a domestic refrigeration device, comprising a plurality of storage chambers which are able to be operated at different temperatures.

A refrigeration device comprising a plurality of storage chambers is disclosed in DE 10 2013 226 341 A1 in which a first throttle point, a first heat exchanger for controlling the temperature of the first storage chamber, a second throttle point and a second heat exchanger for cooling the second storage chamber are connected in series in a refrigerant circuit. The pressure loss at the second throttle point causes a pressure difference between the two heat exchangers, so that the evaporation temperature of the refrigerant in the second heat exchanger is lower than in the first heat exchanger, and thus a lower operating temperature is able to be adjusted in the second storage chamber than in the first storage chamber. The first heat exchanger may operate as an evaporator or as a condenser, depending on the adjustment of the first throttle point. If it is operated as a condenser, the operating temperature of the first storage chamber may attain values at room temperature or even slightly above room temperature.

It is known per se in order to improve the efficiency in a refrigeration device to provide an inner heat exchanger in which a high pressure line section, in which refrigerant heated by compression circulates, and a low pressure line section, in which refrigerant flows from an evaporator to a compressor, are in thermal contact. Such an inner heat exchanger, however, is useless if in a refrigeration device with a plurality of storage chambers, as described above, a first storage chamber is intended to be operated at a high temperature and to this end an evaporator of the storage chamber located in the refrigerant circuit downstream of the high pressure line section of the inner heat exchanger is operated as a condenser. Thus it is only possible to cool the second storage chamber with reduced energy efficiency.

SUMMARY OF THE INVENTION

It is the object of the present invention to provide a refrigeration device comprising a plurality of storage chambers which also permits an energy-efficient operation even when a high operating temperature is selected for a first storage chamber and a low operating temperature is selected for a second storage chamber.

The object is achieved in a refrigeration device comprising at least a first and a second storage chamber and a refrigerant circuit in which a first controllable throttle point, a first heat exchanger for controlling the temperature of the first storage chamber, a second controllable throttle point and a second heat exchanger for cooling the second storage chamber are connected in series between a pressure connection and a suction connection, at least a hot line section located upstream of the second heat exchanger and a cold line section located downstream of the second heat exchanger being routed in thermal contact with respect to one another in order to form an inner heat exchanger and the first heat exchanger is connected to the pressure connection bypassing the hot line section. Thus an energy-efficient cooling operation is ensured for the second storage chamber; on the other hand, heat which could be used for heating the first storage chamber is already prevented from being drawn off from the refrigerant by the inner heat exchanger before reaching the first heat exchanger.

In the simplest case, the hot line section of the inner heat exchanger is located between the first heat exchanger and the second heat exchanger.

A bypass line branch which contains a third controllable throttle point and a third heat exchanger may be provided upstream of the second heat exchanger.

In this case, the hot line section may also be located in the bypass line branch.

Preferably, the hot line section is located upstream of the third heat exchanger in order to permit an energy-efficient cooling operation at this point.

However, the hot line section may also be located in the bypass line branch downstream of the third head exchanger and upstream of a fourth controllable throttle point.

Preferably, two inner heat exchangers are present. These heat exchangers may be distributed on the two branches of the refrigerant circuit, and if one is arranged in the bypass line branch and the other is arranged in the line branch between an outlet of the first heat exchanger and an inlet of the second heat exchanger, the refrigerant is able to reach the second heat exchanger, on whichever path, only after having been previously cooled in one of the inner heat exchangers.

An arrangement is preferred in which the hot line section of the second inner heat exchanger is located between an outlet of the third heat exchanger and an inlet of the second heat exchanger. Thus refrigerant vapor suctioned from the second heat exchanger is initially heated up in the second inner heat exchanger before it reaches the first inner heat exchanger. The cooling obtained by the compressed refrigerant in the first inner heat exchanger, therefore, is less than if the second inner heat exchanger were not present or were connected downstream of the first heat exchanger; as a result, in the case of the second storage chamber requiring refrigeration over a lengthy period of time, it is possible to prevent that a storage chamber which is cooled by the third heat exchanger cools down more than is desired.

An expansion valve may be provided as a controllable throttle point.

Alternatively, a controllable throttle point may be formed by at least two parallel line branches and a valve for controlling the distribution of the refrigerant to the line branches.

In the latter case, one of the parallel line branches may comprise a capillary.

Moreover, one of the parallel through-channels may form a hot line section of a further inner heat exchanger. If, in particular, the first controllable throttle point is constructed in such a manner, there is the possibility of subjecting the first heat exchanger selectively to refrigerant which has not been precooled and which is supplied by bypassing each inner heat exchanger in order to heat the first storage chamber or to supply it via this further inner heat exchanger for cooling the first storage chamber.

BRIEF DESCRIPTION OF THE SEVERAL VIEWS OF THE DRAWING

Further features and advantages of the invention are disclosed from the following description of exemplary embodiments with reference to the accompanying figures, in which.

DESCRIPTION OF THE INVENTION

Figure 1:
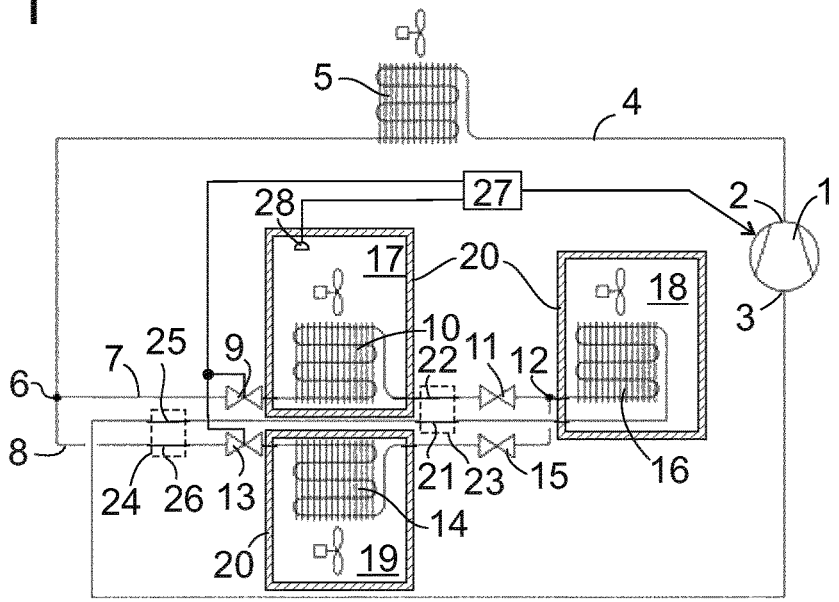
FIG. 1 shows a schematic view of the refrigerant circuit according to a first embodiment of the refrigeration device according to the invention.

The refrigerant circuit shown in FIG. 1 comprises a 1 with a pressure connection 2 and a suction connection 3. A refrigerant line 4 emerging from the pressure connection 2 runs in the circulation direction of the refrigerant via a condenser 5 to a branching 6 and is divided there into two branches 7, 8.

The branch 7 extends via a first controllable throttle point 9, for example an expansion valve, a heat exchanger 10 and a second controllable throttle point 11, to a junction 12. A third controllable throttle point 13, a heat exchanger 14 and a fourth controllable throttle point 15 are connected in series on the branch 8; the branches 7, 8 come together again at the junction 12. From there the refrigerant line 4 runs via a heat exchanger 16 to the suction connection 3 of the compressor 1.

The heat exchangers 10, 16, 14 in each case together with a first storage chamber 17, a second storage chamber 18 and/or a third storage chamber 19 of the refrigeration device are surrounded by a common insulating sleeve 20.

A section 21 of the refrigerant line 4 located downstream of the heat exchanger 16, and a section 22 which connects the heat exchanger 10 to the second controllable throttle point 11, form an inner heat exchanger 23. In the inner heat exchanger 23, the sections 21, 22 may be soldered to one another on the surface or the hot section 22 may be wound around the section 21 or extend in the interior of the cold section 21 in order to discharge heat to the refrigerant vapor flowing in the cold section 21.

A further inner heat exchanger 24 comprises a hot section 25 which is located upstream of the third controllable throttle point 13 and which forms part of the branch 8 and a cold section 26 which is located downstream of the evaporator 16 in the refrigerant line 4. In the view of FIG. 1, the section 26 is located downstream of the section 21 of the inner heat exchanger 23; however, it could also be located upstream thereof or overlap said inner heat exchanger.

An electronic control unit 27 is connected to temperature sensors 28 in the three storage chambers 17, 18, 19 and controls the rotational speed of the compressor 1 and the pressure losses at the controllable throttle points 9, 11, 13, 15 using a comparison of the temperatures prevailing in the storage chambers 17, 18, 19 with set values adjusted by the user.

For the storage chamber 17 which is temperature-controlled via the branch 7, the adjustable set value may be above ambient temperature; then the pressure loss at the throttle point 9 is minimal and the heat exchanger 10 operates as a condenser. After passing through the heat exchanger 10 and before reaching the controllable throttle point 11 the refrigerant is precooled in the inner heat exchanger 23 before it reaches the heat exchanger 16 of the storage chamber 18. Since the pressure in the heat exchanger 16 is inevitably lower than in the heat exchangers 10 and 14, the heat exchanger 16 always operates as an evaporator and the temperature of the storage chamber 18 is lower than that of the storage chambers 17, 19.

Naturally, a temperature below ambient temperature may also be adjusted as a set value for the storage chamber 17; then the control unit 27 sets the pressure loss at the throttle points 9 to a discrete value. The higher this value is and, as a result, the lower the temperature of the storage chamber 17, the lower the temperature of the refrigerant at the outlet of the heat exchanger 10 and the heat exchange in the inner heat exchanger 23 is also correspondingly reduced.

On the branch 8 the section 25 of the inner heat exchanger 24 is mounted upstream of the controllable throttle point 13 and the heat exchanger 14 so that the refrigerant circulating through this section 25 discharges heat before reaching the heat exchanger 14. Temperatures above ambient temperature, therefore, are only able to be reached with difficulty in the storage chamber 19, which however is not necessary since the storage chamber 17 is available for storage at a higher temperature. Temperatures below ambient temperature, however, are able to be reached in the storage chamber 19 with greater efficiency than in the storage chamber 17.

Figure 2:
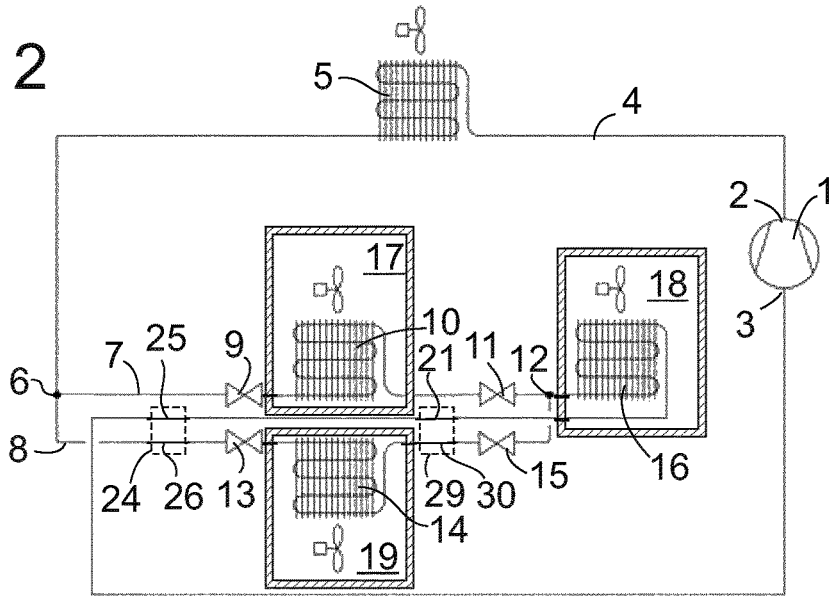
FIG. 2 shows a view of a refrigerant circuit according to a second embodiment.

FIG. 2 shows a second embodiment of the refrigeration device according to the invention. A control unit and temperature sensors in the storage chambers 17, 18, 19 are present in the same manner here as in the first embodiment but for the sake of clarity are not shown in the FIG. The remaining components also substantially correspond to those of FIG. 1; a difference is in the arrangement of the inner heat exchanger. The inner heat exchanger 24 of FIG. 1 is also present identically in FIG. 2 but the inner heat exchanger 21 is replaced by an inner heat exchanger 30 in which a section 31 of the branch 8, which is located between the outlet of the heat exchanger 14 and the controllable throttle point 15, is in thermal contact with the section 21. The branch 7 thus does not have an inner heat exchanger at all but instead the branch 8 has two. Surprisingly, in practice this construction has proved to be particularly efficient. The reason is that the refrigerant flow rate on the branch 8 is normally considerably greater than on the branch 7; even if long running times of the compressor 1 are required for uninterrupted operation in order to keep the storage chamber 18 at its set temperature, or the compressor 1 is operated at a controlled speed, the fact that the refrigerant vapor, with which the compressed refrigerant is brought into thermal contact in the inner heat exchanger 24, has already been preheated in the inner heat exchanger 29 causes supercooling of the storage chamber 19.

Figure 3:
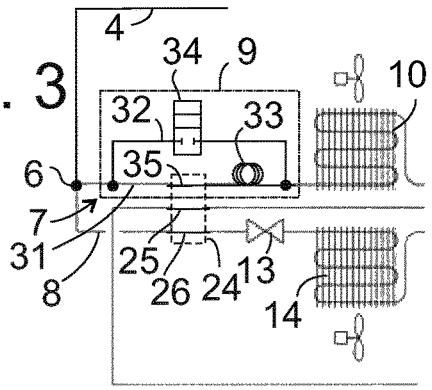
FIG. 3 shows a detail of a refrigerant circuit according to a third embodiment of the invention.

FIG. 3 shows a detail of the refrigerant circuit according to a modification which may be used both in the arrangement of the inner heat exchanger according to FIG. 1 and also according to FIG. 2. The controllable throttle point 9 here is not designed as an expansion valve but it comprises a parallel circuit of two line branches 31, 32, one 31 thereof comprising a capillary 33 and the other 32 thereof comprising a shut-off valve 34. If the shut-off valve 34 is open, practically the entire refrigerant circulating on the branch 7 flows through the shut-off valve 34 and the influence of the capillary 33 on the pressures and the flows in the refrigerant circuit is negligible. The pressure in the heat exchanger 10 is thus practically identical to that in the condenser 5 and the storage chamber 17 may be operated above ambient temperature as described above.

However, if the shut-off valve 34 is closed then the refrigerant in the branch 7 is able to flow only through the capillary 33 and a low pressure and a corresponding low temperature prevail in the heat exchanger 10.

In this case, a portion of the capillary 33 or of a section 35 of the line branch 31 mounted upstream thereof may be incorporated in the inner heat exchanger 24 in order to permit a more efficient cooling operation of the storage chamber 17. Since the refrigerant flow via the capillary 33 is negligible when the shut-off valve 34 is open, this factor has no effect on the possibility of reaching high temperatures in the storage chamber 17.

The capillary 33 may be replaced by an expansion valve.

If desired, the controllable throttle points 11, 13, 15 may also have the construction shown in FIG. 3 for the throttle point 9.

REFERENCE CHARACTERS

1 Compressor
2 Pressure connection
3 Suction connection
4 Refrigerant line
5 Condenser
6 Branching
7 Branch
8 Branch
9 Throttle point
10 Heat exchanger
11 Throttle point
12 Junction
13 Throttle point
14 Heat exchanger
15 Throttle point
16 Heat exchanger
17 Storage chamber
18 Storage chamber
19 Storage chamber
20 Sleeve
21 Cold section
22 Hot section
23 Inner heat exchanger
24 Inner heat exchanger
25 Cold section
26 Hot section
27 Control circuit
28 Temperature sensor
29 Inner heat exchanger
30 Hot section
31 Line branch
32 Line branch
33 Capillary
34 Shut-off valve
35 Section

The invention claimed is:

1. A refrigeration device, comprising:

a first storage chamber and a second storage chamber;

a refrigerant circuit having a first controllable throttle point, a first heat exchanger for controlling a temperature of said first storage chamber, a second controllable throttle point, and a second heat exchanger for cooling said second storage chamber, wherein said first controllable throttle point, said first heat exchanger, said second controllable throttle point, and said second heat exchanger are connected in series between a pressure connection and a suction connection;

a hot line section disposed upstream of said second heat exchanger and a cold line section disposed downstream of said second heat exchanger; and a bypass line branch containing a third controllable throttle point and a third heat exchanger connected upstream of said second heat exchanger and connected in parallel with a line branch containing said first controllable throttle point and said first heat exchanger;

said hot line section and said cold line section being routed in thermal contact with one another to form an inner heat exchanger; and said first heat exchanger being connected to the pressure connection in a way bypassing said hot line section;

wherein said hot line section is connected in said bypass line branch;

wherein the bypass line branch comprises a fourth controllable throttle point downstream of said third heat exchanger and said hot line section is connected between said third heat exchanger and said fourth controllable throttle point; and wherein each of said first controllable throttle point, said second controllable throttle point, said third controllable throttle point, and said fourth controllable throttle point is a device selected from the group consisting of an expansion valve, and a configuration of two parallel lines in which a capillary is located in one of the two parallel lines and a shut-off valve is located in another one of the two parallel lines.

2. The refrigeration device according to claim 1, further comprising a second inner heat exchanger having a hot line section connected between an outlet of said first heat exchanger or of said third heat exchanger and an inlet of said second heat exchanger.

3. The refrigeration device according to claim 2, wherein a cold line section of said second inner heat exchanger is connected between an outlet of said second heat exchanger and the cold line section of said inner heat exchanger.

4. The refrigeration device according to claim 1, wherein at least one throttle point selected from the group consisting of said first controllable throttle point, said second controllable throttle point, and said third controllable throttle point includes an expansion valve.

5. The refrigeration device according to claim 1, wherein at least one throttle point selected from the group consisting of said first controllable throttle point, said second controllable throttle point, and said third controllable throttle point includes at least two parallel line branches and a valve for controlling the distribution of refrigerant to said at least two parallel line branches.

6. The refrigeration device according to claim 5, wherein one of said at least two parallel line branches of said at least one throttle point includes a capillary.

7. The refrigeration device according to claim 5, wherein one of said at least two parallel line branches of said at least one throttle point forms said hot line section of said second inner heat exchanger.

8. The refrigeration device according to claim 1, comprising an electronic control unit configured to temperature control said first storage chamber to be at a high operating temperature near or above an ambient temperature surrounding the refrigeration device, and to temperature control said second storage chamber to be at a low operating temperature below the high operating temperature of said first storage chamber, wherein said first controllable throttle point and said second controllable throttle point are adjustable.

9. A refrigeration device, comprising:

a first storage chamber and a second storage chamber;

a refrigerant circuit having a first controllable throttle point, a first heat exchanger for controlling a temperature of said first storage chamber, a second controllable throttle point, and a second heat exchanger for cooling said second storage chamber, wherein said first controllable throttle point, said first heat exchanger, said second controllable throttle point, and said second heat exchanger are connected in series between a pressure connection and a suction connection;

a hot line section disposed upstream of said second heat exchanger and a cold line section disposed downstream of said second heat exchanger;

a bypass line branch containing a third controllable throttle point and a third heat exchanger connected upstream of said second heat exchanger and connected in parallel with a line branch containing said first controllable throttle point and said first heat exchanger; and a second inner heat exchanger;

said hot line section and said cold line section being routed in thermal contact with one another to form an inner heat exchanger; and said first heat exchanger being connected to the pressure connection in a way bypassing said hot line section;

wherein said hot line section is connected in said bypass line branch;

wherein said hot line section is connected upstream of said third heat exchanger;

wherein said second inner heat exchanger has a hot line section connected between an outlet of said first heat exchanger or of said third heat exchanger and an inlet of said second heat exchanger; and wherein each of said first controllable throttle point, said second controllable throttle point, and said third controllable throttle point is a device selected from the group consisting of an expansion valve, and a configuration of two parallel lines in which a capillary is located in one of the two parallel lines and a shut-off valve is located in another one of the two parallel lines.

10. The refrigeration device according to claim 9, wherein a cold line section of said second inner heat exchanger is connected between an outlet of said second heat exchanger and the cold line section of said inner heat exchanger.

* * * * *